US006554155B1

(12) United States Patent
Beggins

(10) Patent No.: US 6,554,155 B1
(45) Date of Patent: Apr. 29, 2003

(54) BOTTLE COOLER APPARATUS WITH QUICK PLUNGE INSERTION FEATURE

(76) Inventor: Thomas M. Beggins, 33202 Paseo Blanco, San Juan Capistrano, CA (US) 92675

( * ) Notice: Subject to any disclaimer, the term of this patent is extended or adjusted under 35 U.S.C. 154(b) by 950 days.

(21) Appl. No.: 08/792,765

(22) Filed: Feb. 4, 1997

Related U.S. Application Data

(63) Continuation of application No. 08/543,079, filed on Oct. 13, 1995, now abandoned.

(51) Int. Cl.[7] ..... A47J 41/00; B65D 8/00

(52) U.S. Cl. ..... 220/739; 220/8; 220/592.16; 220/592.2; 220/592.24; 220/592.25; 220/902; 220/903

(58) Field of Search ..... 220/739, 8, 903, 220/629, 630, 592.16, 592.17, 592.2, 592.24, 592.25, 902; 215/12.1, 13.1; 62/457.3, 457.4, 457.8

(56) References Cited

U.S. PATENT DOCUMENTS

| | | | | |
|---|---|---|---|---|
| 930,219 A | * | 8/1909 | Paalen | 215/12.1 |
| 995,700 A | | 6/1911 | Maynard | |
| 1,744,498 A | | 1/1930 | Payson et al. | |
| 1,999,670 A | | 4/1935 | Strouse et al. | |
| 2,556,893 A | | 6/1951 | Zwiebach et al. | |
| 2,773,358 A | | 12/1956 | Palmer et al. | |
| 2,805,556 A | | 9/1957 | Wang | |
| 2,889,065 A | | 6/1959 | Lawlor | |
| 3,120,319 A | | 2/1964 | Buddrus | |
| 3,155,260 A | | 11/1964 | Widener | |
| 3,229,840 A | | 1/1966 | Filleul | |
| 3,302,428 A | | 2/1967 | Stoner et al. | |
| 3,553,976 A | | 1/1971 | Cumine et al. | |
| 3,613,761 A | | 10/1971 | Moody | |
| 3,779,298 A | | 12/1973 | Piccirilli et al. | |
| 3,910,328 A | | 10/1975 | Marcoux | |
| 3,987,643 A | | 10/1976 | Willis | |
| 3,998,072 A | | 12/1976 | Shaw | |
| 4,114,759 A | | 9/1978 | Maloney, Jr. | |
| 4,240,272 A | | 12/1980 | Tiede et al. | |
| 4,281,520 A | | 8/1981 | Norwood | |
| 4,300,612 A | | 11/1981 | Schroeder, Jr et al. | |
| 4,456,134 A | | 6/1984 | Cooper | |
| 4,510,769 A | | 4/1985 | McClellan, Jr. | |
| 4,708,254 A | | 11/1987 | Byrns | |
| 4,811,858 A | | 3/1989 | Augur | |
| 4,823,974 A | * | 4/1989 | Crosser | 62/457.8 X |
| 5,390,804 A | | 2/1995 | Beggins | |

FOREIGN PATENT DOCUMENTS

| | | | | |
|---|---|---|---|---|
| CA | 1251744 | | 4/1983 | |
| DE | 2616502 | | 4/1976 | |
| DE | 3534103 | | 9/1985 | |
| DE | 3417061 | * | 11/1985 | 62/457.8 |
| FR | 846816 | | 6/1938 | |
| FR | 1013815 | | 3/1950 | |
| GB | 0021585 | * | 9/1912 | 62/457.8 |
| GB | 990011 | | 11/1963 | |

* cited by examiner

*Primary Examiner*—Stephen P. Garbe
*Assistant Examiner*—Niki M. Eloshway
(74) *Attorney, Agent, or Firm*—Price and Gess

(57) ABSTRACT

An insulating device for bottles having a lower cylindrical enclosure which telescopically receives an upper enclosure having a dome-shaped upper end, the upper and lower enclosures being provided with mating threads adapted to achieve a quick plunge insertion and sealing feature.

23 Claims, 2 Drawing Sheets

BOTTLE COOLER APPARATUS WITH QUICK PLUNGE INSERTION FEATURE

This is a continuation of application Ser. No. 08/543,079, filed Oct. 13, 1995, now abandoned.

BACKGROUND OF THE INVENTION

1. Field of the Invention

The subject invention relates to apparatus for maintaining cold containerized liquids in a cool state and, more particularly, to a two-part telescopic lightweight portable bottle cooler apparatus.

2. Description of Related Art

A number of structures for insulating containers have been proposed in the prior art. Perhaps the most familiar structure is the cylindrical foam jacket or sleeve conventionally used to cool standard cylindrical cans containing beer, soda, and the like. Such devices are typically inadequate or only partially effective. Various such insulating structures exhibit practical drawbacks in that they often leave the bottle contents partially exposed to the air and/or employ cumbersome attachments mechanisms such as mechanical clasps or snaps.

Applicant's U.S. Pat. No. 5,390,804 discloses a bottle insulating device having a lower cylindrical enclosure which telescopically receives an upper enclosure having a dome-shaped upper end and an opening therein of a diameter selected to determine the extent to which the upper enclosure slides down the bottle neck and hence the extent to which the upper enclosure extends into the lower enclosure. While this structure exhibits several advantages over prior art cooler apparatus, it has appeared to Applicant that further improvements could provide even more useful and effective cooler apparatus.

OBJECTS AND SUMMARY OF THE INVENTION

Accordingly, it is an object of the invention to provide an improved insulating apparatus;

It is another object of the invention to provide such an insulating apparatus particularly adapted for convenient use with bottles such as beer bottles, wine bottles, and the like;

It is another object of the invention to provide such an apparatus that is readily manufactured and easily used;

It is another object of the invention to provide an airtight seal between top and bottom portions of an insulating structure, as well as between the top portion and the bottle;

It is another object of the invention to provide a bottle insulating structure which is particularly pleasing in appearance and may be used as an advertising or promotional tool; and It is another object of the invention to provide a bullet-nosed bottle cooler apparatus having a quick plunge insertion feature.

The invention contemplates a lower cylindrical enclosure and an upper enclosure which telescopically fits into the lower enclosure. The lower enclosure is closed at one end and open at the other end for receiving the lower end of a bottle and includes a relatively steeply arched first thread on the inside which preferably begins at the open end and spirals down to the bottom of the lower enclosure. The upper enclosure has a domed upper end which unitarily forms into a cylindrical lower section. This lower cylindrical section telescopically fits into the opening in the lower cylindrical enclosure and has a second thread matching the first thread of the lower enclosure beginning at the lower end thereof and spiralling part way up the side of the upper enclosure. An opening is formed in the upper domed portion and is sized to pass over the capped end of a bottle neck and slide down the neck until the neck of the bottle reaches a diameter which stops further progress or the upper domed portion comes to rest on the shoulder of the bottle.

The structure according to the invention thus provides a "quick plunge" insertion feature which retains the advantages of direct telescopic insertion to accommodate various height bottles while providing a positive retaining action between the upper and lower enclosures. The "quick plunge" feature preferably provides complete insertion with a minimum of turning of the upper enclosure.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide readily manufacturable, easily used and aesthetically pleasing bottle insulating apparatus.

Figure 1:
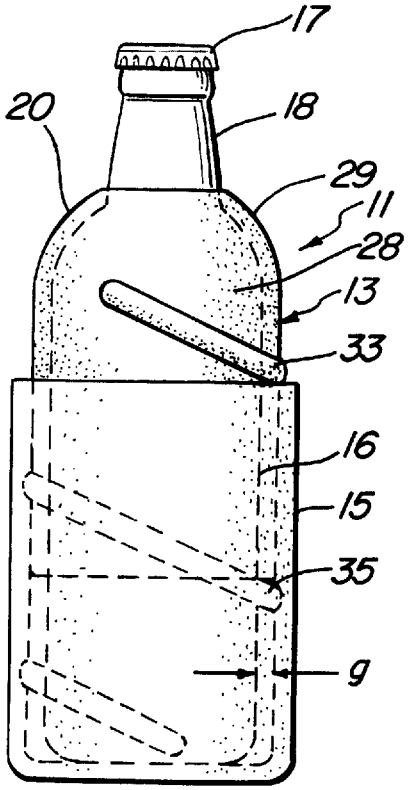
FIG. 1 is a front elevational view illustrating the preferred embodiment of the invention.
Figure 3:
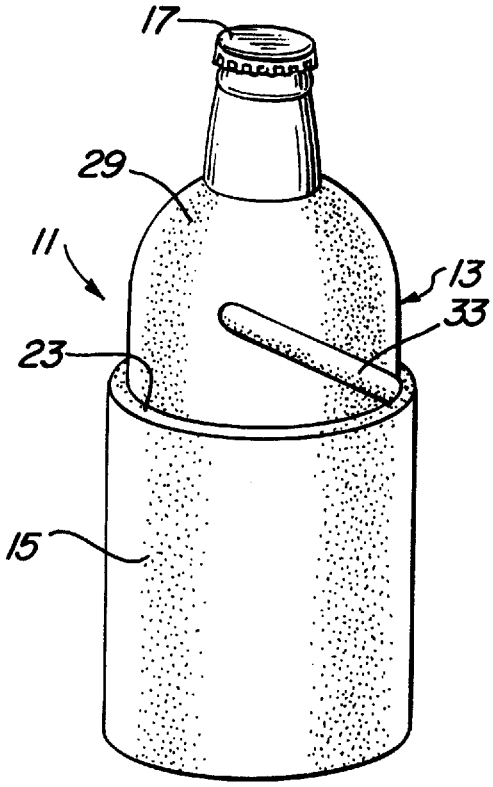
FIG. 3 is a perspective view of the preferred embodiment.
Figure 2:
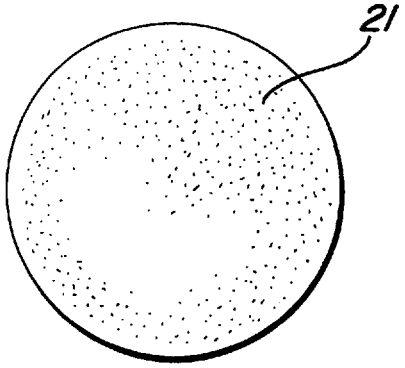
FIG. 2 is a bottom view of the embodiment of FIG. 1.
Figure 4:
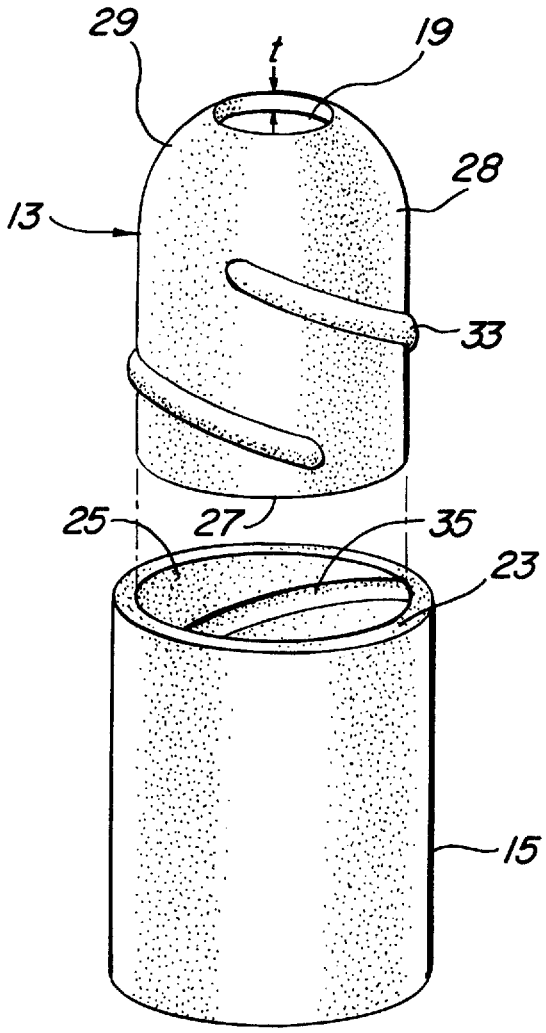
FIG. 4 is an exploded view of a cooler cup according to the preferred embodiment.

As shown in FIG. 1, the cooler apparatus 11 of the preferred embodiment includes a lower cylindrical enclosure 15 and an upper enclosure 13. The upper enclosure 13 and the lower enclosure 15 are preferably formed of a relatively rigid insulating material such as, for example, styrofoam, which provides structural integrity as well as insulating properties.

As further shown in FIG. 1, these enclosures 13, 15 are installed about a bottle 17. The bottle 17 has a side 16 and a neck 18 which generally increases in diameter from the top capped portion of the bottle to the shoulder 20 of the bottle 17.

The lower enclosure 15 is generally of a uniform thickness "g" and comprises a cylinder having an inner cylindrical surface 25, an enclosed bottom 21, and an upper rim 23. The bottom surface 21 may be flat but preferably incorporates a slightly raised portion to assist in seating the bottom of the bottle 17.

The upper enclosure 13 includes a dome-shaped or "bullet-nose" upper end 29 which is integrally and unitarily formed into a lower cylindrical section 28 terminating in a circular rim 27. The upper enclosure 13 is generally of a uniform thickness "t" and includes a circular opening 19 formed in the dome-shaped upper end 29.

Figure 5:
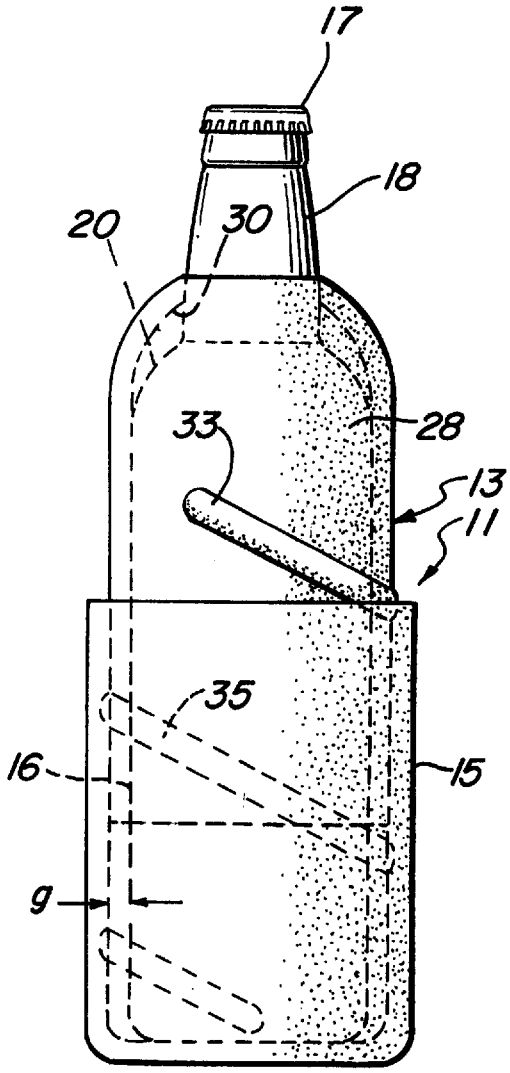
FIG. 5 is a front elevational view of an alternate embodiment.

The circular rim 27 of the upper enclosure 13 is of a diameter selected to fit telescopically into the circular opening of the lower enclosure 15 defined by its upper rim 23. The diameter of the opening 19 in the bullet-nosed dome 29 is also of a specially selected size. In particular, the diameter of opening 19 is selected such that the opening 19 will initially pass over the capped end of the bottle 17 and slide down over the bottle neck 18 to the point where the diameter of the neck 18 or contact with the bottle shoulder 20 precludes further downward motion of the upper enclosure 13. The diameter selected for the opening 19 may thus determine the extent to which the lower cylindrical section 28 of the upper enclosure 13 extends into the lower enclosure 15. As illustrated, for example, in FIG. 5, this mechanism for determining the position of the upper enclosure 13 permits the use of a dome-shaped configuration for the upper end 29 of the upper enclosure 13, despite a considerable resulting gap between the shoulder 20 of the bottle 17 and the interior surface 30 of the dome-shaped portion 29.

As shown in FIGS. 1, 3, 4, and 5, the upper enclosure 13 has a male thread 33 on the outside, starting at the bottom of the upper enclosure 13 and spiraling up about two-thirds of the way to the top, while the lower enclosure 15 has a mating female thread 35 on the interior thereof starting at the top of the lower enclosure 15 and spiraling down to the bottom thereof. The "steepness" of the threads 33, 35 are preferably selected such that minimal turning of the upper enclosure 13 is required to secure the upper enclosure 13 with the lower enclosure 15, thus providing a deep plunge, quick insertion feature. This structure allows the upper enclosure 13 to screw in and out of the lower enclosure 15, while telescoping up and down to adjust to the different heights of a variety of bottles, while allowing the circular opening 19 to come to rest on shoulder 20 or to come into locking relation with the neck 18 of the bottle.

While the threads 33, 35 are shown as continuous, they could, of course, be intermittent or segmented in various alternative embodiments. A male thread could also be provided on the lower enclosure 15 and a female thread on the upper enclosure 13 in various embodiments. The thread on the lower enclosure preferably winds all the way to the bottom thereof in order to allow the upper enclosure 13 and the lower enclosure 15 to be fitted one within the other for shipping purposes.

Thus, in operation, the lower end of a bottle 17 is placed into the lower enclosure 15. The upper enclosure 13 is then installed, by passing the opening 19 over the bottle neck 18, while simultaneously rotating the upper cylindrical section 28 into the lower enclosure 15. The downward progress of the upper enclosure 13 stops when the opening 19 reaches a point where it comes into a locking relation with the neck 18 of the bottle 17 or comes to rest on the bottle shoulder 20. Thus, a two-part, telescopic, self-sealing, lightweight, portable bottle cooler apparatus is provided. This apparatus completely encloses the cooled contents of such bottles and maintains the contents in the cooled state, while permitting the contents to be readily imbibed.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A cooler apparatus for an entirely rigid bottle having a top, a neck which increases in diameter down its length, and an end, said cooler apparatus comprising:

a lower cylindrical enclosure means comprising an insulating foam material for thermally insulating said rigid bottle and having a closed end and a circular upper rim defining a circular opening into a cylindrical interior for receiving the end of said rigid bottle;

an upper enclosure means comprising an insulating foam material for thermally insulating said rigid bottle and having a dome-shaped upper end unitarily and integrally forming into a lower cylindrical section, the lower cylindrical section terminating in a circular rim sized in diameter to telescopically interfit into the interior cylindrical surface of said lower enclosure means;

said upper dome-shaped portion including a circular opening means therein sized in diameter to pass over the top of said rigid bottle and come into a locking relation with the neck of said rigid bottle at a selected diameter along said neck, said locking relation preventing further downward progress of said upper dome-shaped portion along said neck, the diameter of said opening means determining the ultimate and final extent to which the lower cylindrical section of said upper enclosure means extends into said lower cylindrical enclosure means;

a first thread means located on the inside of said lower cylindrical enclosure means; and a second thread means formed on a lower portion of the exterior surface of said upper enclosure means and extending to a point at least halfway up the side of said upper enclosure means, said first and second thread means cooperating with one another for providing insertion of said upper enclosure means into said lower enclosure means, said insertion continuing until said locking relationship with the neck of said rigid bottle is achieved, said first and second thread means thereafter cooperating for retaining said upper enclosure means located within said lower enclosure means.

2. The cooler apparatus of claim 1 wherein said bottle is spaced apart from said cylindrical interior by a distance equal to the thickness of said upper enclosure.

3. The cooler apparatus of claim 1 wherein said insertion is accomplished by a relative rotation of said upper enclosure means with respect to said lower enclosure means through as few degrees as is necessary to achieve secure attachment of said upper enclosure means within said lower enclosure means.

4. The cooler apparatus of claim 3 wherein said lower enclosure means has a depth sized to receive at least one-fourth of the length of said bottle and wherein said first thread means begins at said circular upper rim.

5. The cooler apparatus of claim 1 wherein said lower enclosure means has an inner bottom surface and said first thread means terminates against said inner bottom surface.

6. The cooler apparatus of claim 1 wherein the said upper and lower enclosure means are each constructed entirely of a rigid insulating foam material.

7. A cooler apparatus for an entirely rigid bottle having a top, a neck, and an end comprising:

a lower cylindrical enclosure means for thermally insulating said rigid bottle having a closed end and a circular opening into a cylindrical interior for receiving the end of said rigid bottle;

an upper enclosure means for thermally insulating said rigid bottle and having a dome-shaped upper end unitarily and integrally forming into a lower cylindrical section, the lower cylindrical section terminating in a circular rim sized in diameter to telescopically interfit into the interior cylindrical surface of said lower enclosure means;

said upper dome-shaped portion including a circular opening therein sized in diameter to pass over the top of said rigid bottle and down the neck of said rigid bottle until further downward progress of said upper dome-shaped portion is terminated by said rigid bottle, thereby determining the ultimate and final extend to which the lower cylindrical section of said upper enclosure means extends into said lower cylindrical enclosure means;

a first thread means located on the inside of said lower cylindrical enclosure means; and a second thread means formed on a portion of the exterior surface of said upper enclosure means, said first and second thread means cooperating with one another to provide a insertion of said upper enclosure means into said lower enclosure until said downward progress is terminated by said rigid bottle and for thereafter retaining said upper enclosure means located within said lower enclosure means.

8. The cooler apparatus of claim 7 wherein said bottle is spaced apart from said cylindrical interior by a distance equal to the thickness of said upper enclosure.

9. The cooler apparatus of claim 9 wherein the downward progress of said upper enclosure means is stopped by contact with a shoulder portion of said rigid bottle.

10. The cooler apparatus of claim 9 wherein said downward progress of said upper enclosure means is stopped by contact between said circular opening and the neck of said rigid bottle.

11. The cooler apparatus of claim 7 wherein said insertion is accomplished by a relative rotation of said upper enclosure means with respect to said lower enclosure means through as few degrees as is necessary to achieve secure attachment of said upper enclosure means within said lower enclosure means.

12. The cooler apparatus of claim 7 herein said lower enclosure means has a depth sized to receive at least one-fourth of the length of said bottle and wherein said first thread means begins at said circular upper rim.

13. The cooler apparatus of claim 7 wherein the said upper and lower enclosure means are each constructed entirely of a rigid insulating foam material.

14. A cooler apparatus for an entirely rigid bottle having a top, a neck, and an end comprising:

a lower cylindrical enclosure means for comprising an insulating foam material for thermally insulating said rigid bottle and having a closed end and a circular upper rim defining a circular opening into a cylindrical interior for receiving the end of said bottle;

an upper enclosure means comprising an insulating foam material for thermally insulating said rigid bottle and having a dome-shaped upper end unitarily and integrally forming into a lower cylindrical section, the lower cylindrical section terminating in a circular rim sized in diameter to telescopically interfit into the interior into the interior cylindrical surface of said lower enclosure means;

said upper dome-shaped portion including a circular opening therein sized in diameter to pass over the top of said rigid bottle and down the neck of said rigid bottle until further downward progress of said upper dome-shaped portion is terminated by said rigid bottle, thereby determining the extent to which the lower cylindrical section of said upper enclosure means extends into said lower cylindrical enclosure means;

a first thread means located on the inside of said lower cylindrical enclosure means; and a second thread means formed on a portion of the exterior surface of a lower portion of said upper enclosure means and extending to a point at least halfway up the side of said upper enclosure means, said first and second thread means engaging one another substantially before said opening passes entirely over said neck, said first and second thread means further cooperating with one another to provide a insertion of said upper enclosure means into said lower enclosure until said downward progress is terminated by said rigid bottle and for thereafter retaining said upper enclosure means located within said lower enclosure means.

15. The cooler apparatus of claim 14 wherein said rigid bottle is spaced apart from said cylindrical interior by a distance equal to the thickness of said upper enclosure means.

16. The cooler apparatus of claim 14 wherein the downward progress of said upper enclosure means is stopped by contact with a shoulder portion of said rigid bottle.

17. The cooler apparatus of claim 16 wherein said lower enclosure means has a depth sized to receive at least one-fourth of the length of said bottle and wherein said first thread means begins at said circular upper rim.

18. The cooler apparatus of claim 14 wherein said downward progress of said upper enclosure means is stopped by contact between said circular opening and the neck of said rigid bottle.

19. The cooler apparatus of claim 14 wherein said insertion is accomplished by a relative rotation of said upper enclosure means with respect to said lower enclosure means through as few degrees as is necessary to achieve secure attachment of said upper enclosure means within said lower enclosure means.

20. The cooler apparatus of claim 14 wherein the said upper and lower enclosure means are each constructed entirely of a rigid insulating foam material.

21. The apparatus comprising:

an entirely rigid bottle having a top, a neck, and an end;

a lower cylindrical enclosure means comprising an insulating foam material for thermally insulating said rigid bottle and having a closed end and a circular upper rim defining a circular opening into a cylindrical interior for receiving the end of said bottle;

an upper enclosure means comprising an insulating foam material for thermally insulating said rigid bottle and having a dome-shaped upper end unitarily and integrally forming into a lower cylindrical section, the lower cylindrical section terminating in a circular rim sized in diameter to telescopically interfit into the interior cylindrical surface of said lower enclosure means;

said upper dome-shaped portion including a circular opening therein sized in diameter to pass over the top of said rigid bottle and down the neck of said rigid bottle until further downward progress of said upper-dome-shaped portion is terminated by said rigid bottle, thereby determining the extent to which the lower cylindrical section of said upper enclosure means extends into said lower cylindrical enclosure means;

a first thread means located on the inside of said lower cylindrical enclosure means; and a second thread means formed on a portion of the exterior surface of a lower portion of said upper enclosure means and extending to a point at least halfway up the side of said upper enclosure means, said first and second thread means engaging one another substantially before said opening passes entirely over said neck, said first and second thread means further cooperating with one another to provide a insertion of said upper enclosure means into said lower enclosure until said downward progress is terminated by said rigid bottle and for thereafter retaining said upper enclosure means located within said lower enclosure means.

22. The cooler apparatus of claim 21 wherein said first and second thread means are so configured that said insertion is accomplished by a relative rotation of said upper enclosure means with respect to said lower enclosure means through as few degrees as is necessary to achieve secure attachment of said upper enclosure means within said lower enclosure means.

23. The cooler apparatus of claim 21 wherein the said upper and lower enclosure means are each constructed entirely of a rigid insulating foam material.

* * * * *